United States Patent [19]

Marc

[11] Patent Number: 5,068,983

[45] Date of Patent: Dec. 3, 1991

[54] SHOE INSOLE

[75] Inventor: Michel Marc, Wellesley, Mass.

[73] Assignee: Clint, Inc., Natick, Mass.

[21] Appl. No.: 621,630

[22] Filed: Dec. 3, 1990

Related U.S. Application Data

[63] Continuation of Ser. No. 512,039, Apr. 13, 1990, abandoned, which is a continuation of Ser. No. 340,751, Apr. 10, 1989, abandoned.

[51] Int. Cl.[5] ..... A43B 13/41; A43B 13/40

[52] U.S. Cl. ..... 36/44; 36/43; 36/71

[58] Field of Search ..... 36/43, 44, 71; 128/619, 128/614, 586

[56] References Cited

U.S. PATENT DOCUMENTS

| | | | |
|---|---|---|---|
| 4,408,402 | 10/1983 | Looney | 36/44 |
| 4,435,910 | 3/1984 | Marc | 36/44 |
| 4,510,700 | 4/1985 | Brown | 36/44 |
| 4,513,518 | 4/1985 | Jalbert et al. | 36/43 |
| 4,580,356 | 4/1986 | David | 36/43 |
| 4,633,598 | 1/1987 | Moronaga et al. | 36/44 |
| 4,642,912 | 2/1987 | Wildman et al. | 36/44 |
| 4,674,204 | 6/1987 | Sullivan et al. | 36/44 |
| 4,694,589 | 9/1987 | Sullivan et al. | 36/44 |
| 4,782,605 | 11/1988 | Chapnick | 36/44 |
| 4,793,078 | 12/1988 | Andrews | 36/44 |
| 4,808,469 | 2/1989 | Hiles | 36/44 |
| 4,823,420 | 4/1989 | Bartneck | 36/44 |
| 4,823,483 | 4/1989 | Chapnick | 36/44 |
| 4,962,593 | 10/1990 | Brown | 36/44 |

*Primary Examiner*—Steven N. Meyers

*Attorney, Agent, or Firm*—Wolf, Greenfield & Sacks

[57] ABSTRACT

A shoe insole formed by a resilient base piece adapted to be disposed primarily at the heel area and having a cupped peripheral wall. A heel piece is disposed within the base piece and constructed for improved shock absorption at the heel. A top cushioning layer is provided overlying the resilient base piece and heel piece. The top cushioning layer extends over the base piece from the heel area thereof and forwardly of the base piece so as to principally underlie the foot ball and toe area.

16 Claims, 3 Drawing Sheets

32
30
10
14
15
3
4
20
19
18
17
16
12

SHOE INSOLE

This application is a continuation of Ser. No. 07/512,039 filed Apr. 13, 1990 which is a continuation of application Ser. No. 07/340,751, filed Apr. 10, 1989, both abandoned.

BACKGROUND OF THE INVENTION

1. Field of the Invention

The present invention relates in general to an improved insole for shoes and pertains, more particularly, to an improved insole that is of more simplified construction and that is adapted for use with, for example running shoes, sneakers or the like.

2. Background Discussion

Running shoes are presently constructed using a preformed insole that is adapted to conform to the arch of the foot for improved comfort and support in running. The entire insole is usually preformed with a raised area that is initially molded to conform to the arch. However, once the shoe has been used, sometimes even for only a short period of time the insole loses its preformed support and as a result support is lost particularly for the arch of the foot and also for other rear areas of the foot.

Reference is also now made herein to my previously granted U.S. Pat. No. 4,435,910 on a shoe insole.

It is an object of the present invention to provide an improved insole, particularly for running shoes, sneakers or the like and which supplies improved support and comfort for the foot with the support being provided in a substantially permanent manner. In accordance with the invention, the insole is constructed so that the contour of the insole is maintained even after extensive use of the shoe.

Another object of the present invention is to provide an improved insole for running shoes having a heel section that is cupped for capturing the heel of the foot so as to avoid side motion of the foot in the shoe.

Still another object of the present invention is to provide an improved insole for running shoes which permits the insole to conform to the foot of each individual wearer.

A further object of the present invention is to provide an improved insole for running shoes that is light in weight weighing preferably approximately one ounce.

Another object of the present invention is to provide an improved insole for running shoes in which the insole is breathable and anti-bacterial.

Another object of the present invention is to provide an improved insole for running shoes in which the insole is comprised of a combination of different foams including an intermediate foam that displays a substantially perfect memory and that cushions and absorbs shocks. This foam is characterized by retaining its original position even after extensive use of the shoe.

A further object of the present invention is to provide an improved insole that is of more simplified construction and that is in particular characterized by good impact absorption, particularly at the heel area of the insole.

SUMMARY OF THE INVENTION

To accomplish the forgoing and other objects features and advantages of the invention, there is provided a shoe insole which is particularly adapted for use in running shoes, running sneakers or the like footwear.

This insole is comprised of multiple layers that incorporate a combination of foam materials. There is provide a resilient base piece adapted to conform to the foot and having a base surface, a top surface and cupped periphery for accommodating the heel and extending to the arch area. A heel piece is disposed in a cutout opening in the base piece under the heel for absorption of shock. A top cushioning layer has a portion thereof affixed to and overlying the resilient base piece and heel piece. This top cushioning layer has a top surface adapted to receive the foot. The resilient base piece extends from the heel area forwardly to a thin front edge. A top cushioning layer extends over the base piece from the heel area thereof and forwardly of the thin front edge of the base piece to underlie the foot ball and toe area.

In accordance with additional features of the present invention the resilient base piece has a recess in the top surface extending about the base of the cupped periphery and for accommodating the top cushioning layer. The cupped periphery is comprised of a cupped wall that has ribs on the outer surface thereof and which extend between a top edge of the cupped wall and the base piece base surface. The cupped wall is preferably smooth on its inner surface. The width of the heel piece is less than the width of the base piece at the base and top surfaces. The thickness of the heel piece is substantially the same as the base piece thickness between the top and bottom surfaces thereof so that the bottom of the heel piece is substantially flush with the base piece base surface. The heel piece may be constructed of a visco-elastic material. This may be a soft spongy material for shock absorption but further characterized by fast recovery. The resilient base piece may be constructed of a material having a memory such as a polyvinylchloride material. The top cushioning layer preferably has holes therethrough between top and bottom surfaces thereof. This top cushioning layer may be of a foam material such as a polyurethane material.

BRIEF DESCRIPTION OF THE DRAWINGS

Numerous other objects, features and advantages of the invention should now become apparent upon a reading of the following detailed description taken in conjunction with the accompanying drawings in which.

DETAILED DESCRIPTION

Figures 1, 2, 3:
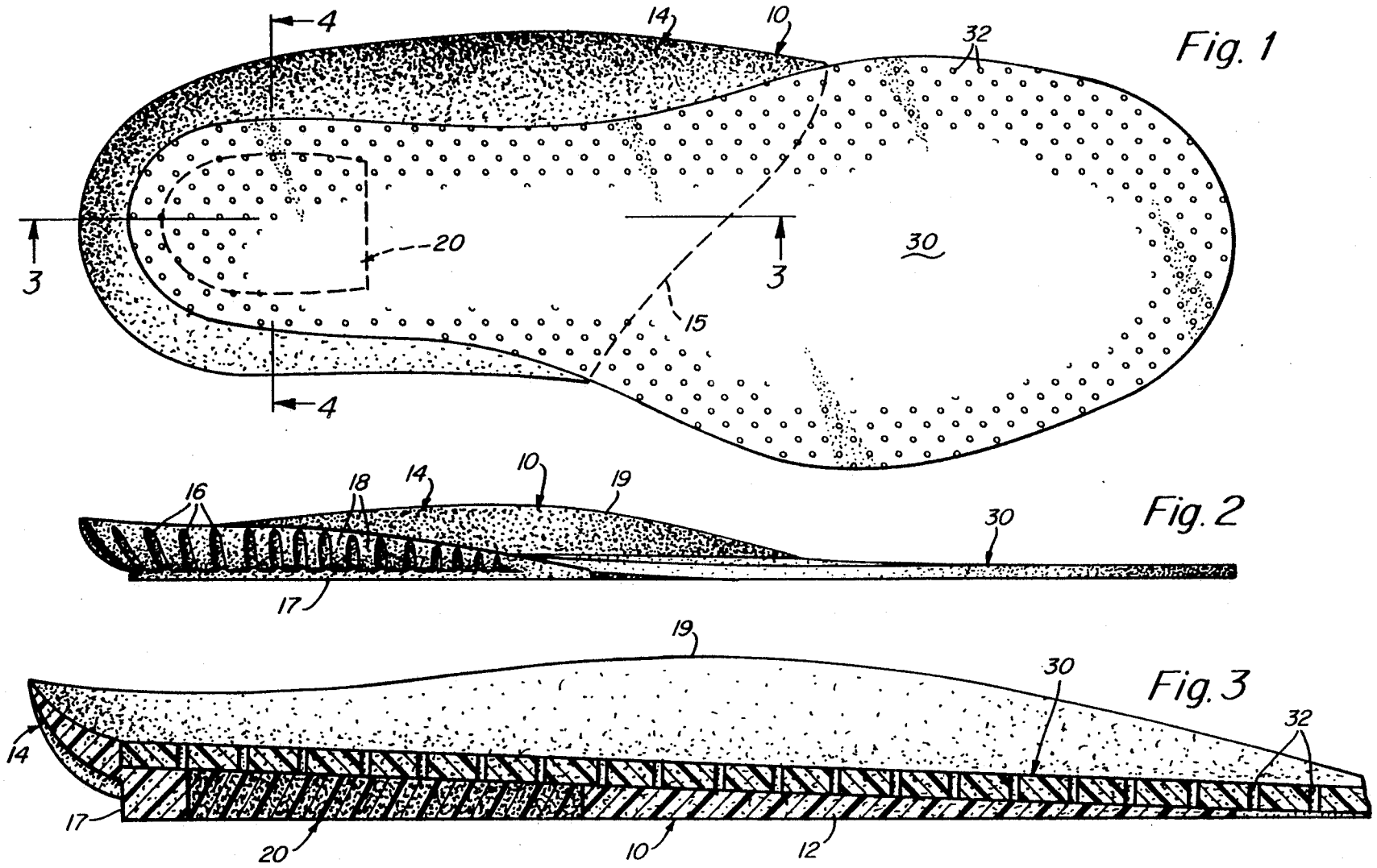
FIG. 1 is a top plan view of the shoe insole of the present invention.
FIG. 2 is a side elevation view of the shoe insole of FIG. 1.
FIG. 3 is cross-sectional view showing further details and as taken along lines 3—3 of FIG. 1.
Figure 4:
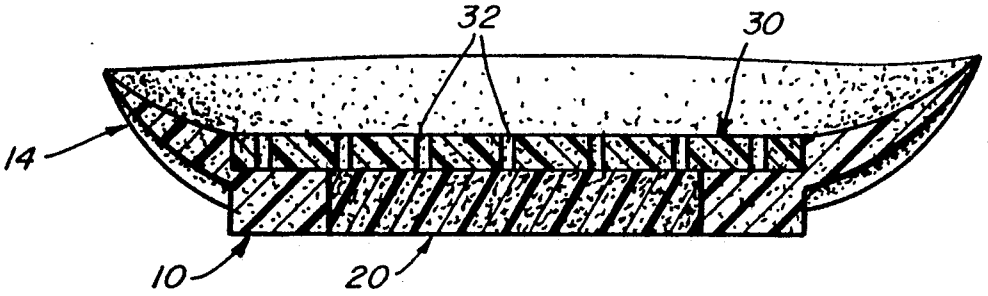
FIG. 4 is a further cross-sectional view taken along line 4—4 of FIG. 1.

Referring to the drawing, there is shown a preferred embodiment of a shoe insole constructed in accordance with the principles of the present invention and adapted primarily for running shoes. The insole is constructed of a combination of different foam materials and is particularly adapted and constructed so as to provide a foot conforming surface that has a substantially perfect memory and which will retain its formed shape even after extensive use of the running shoe. The insole is also constructed so as to operate effectively in absorbing shock and impact of the foot particularly at the heel area. Furthermore, the insole is constructed so as to provide improved and proper support for the arch of the foot. The arch support is particular, in accordance with the insole of this invention is also maintained even after extensive use of the shoe in which the insole is employed. This insole may also be used either directly in the manufacture of shoes or can be sold separately as an insert to be used with previously worn running shoes.

The drawings herein illustrate a preferred embodiment of the shoe insole. The insole is comprised of a resilient base 10 having a substantially tapered base wall 12 and a substantially cupped peripheral wall 14. The walls 12 and 14 basically accommodate the heel area of the foot and extend toward the arch area.

As illustrated in, for example, FIG. 3 the base wall 12 is tapered toward a relatively thin front edge 15. In this regard refer to FIGS. 5 and 6 for an illustration of the contour of the front edge 15. Similarly, refer to the perspective view of FIG. 6 for an illustration of the recess 13 in the base piece 10. The recess 13 is of a configuration that essentially matches the contour of the rear portion of the top layer 30 so that the top layer 30 snugly fits in this recess such as is illustrated in, for example, FIGS. 1 and 5.

The cupped peripheral wall 14 is also tapered up to a top edge 19. The inwardly facing surface of the cupped peripheral wall 14 is substantially smooth. It is this surface that may come in contact with the rear part of the foot. As illustrated in, for example, FIG. 2, the outer surface of the cupped peripheral wall 14 is provide with a series of upstanding spacedly disposed recesses 16. These recesses extend from the base edge 17 to terminate just short of the top edge 19. These parallel spaced recesses define therebetween separate spaced ribs 18. The ribs 18 tend to be somewhat wider at the rear of the heel area than at the more forward parts of the cupped peripheral wall.

Figure 6:
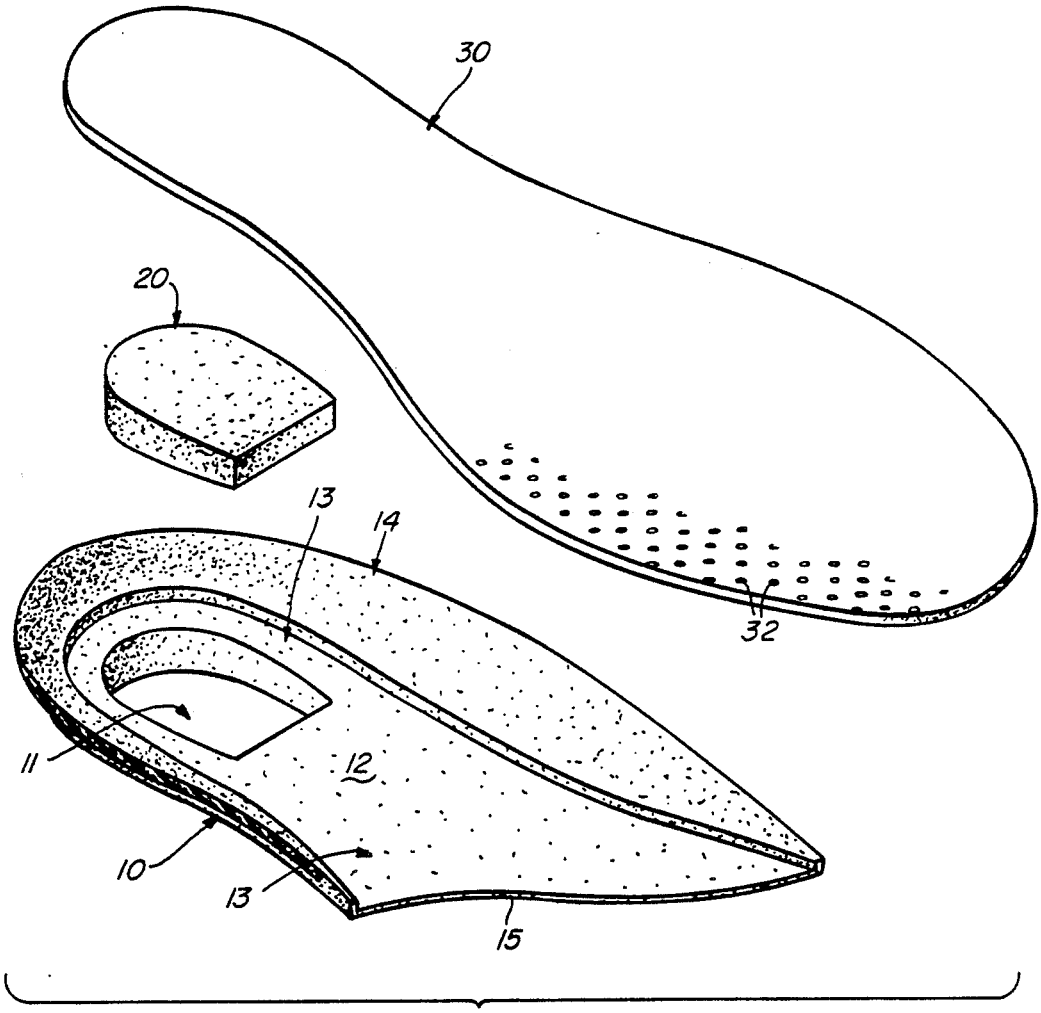
FIG. 6 is an exploded perspective view showing the three basic components of the shoe insole of the present invention

The base wall 12 of the base piece 10 is also provided, at the heel area, with an opening 11 as illustrated in FIG 6. The opening 11 extends between the opposite surfaces defining the wall 12. The opening 11 accommodates the heel piece 20. In this regard refer to FIG. 6 and also refer to the somewhat tapered nature of the heel piece 20 as illustrated in FIG. 3. FIG. 3 also illustrates the dimensions of the relative pieces so that the bottom of the heel piece 20 is substantially flush with the bottom of the base piece 10 when the pieces are assembled together.

The base piece 10 is preferably constructed of a foam material. Examples of this material include polyvinylchloride and polyvinylchloride foam. The polyvinylchloride foam functions as a memory and cushions and absorbs shock yet permitting the material to return to its initial position.

The heel piece 20 may also be constructed of a foam material. This material is preferably a visco-elastic compound. The material is preferably a soft spongy material which absorbs shock and yet is characterized by a fast recovery.

The material of the base piece 10 is generally somewhat stiffer than the material of the heel piece 20. Thus, the heel piece 20 provides, in particular, improved shock absorption directly at the heel of the foot. In this regard, it is noted that the heel piece 20 is primarily disposed only at the heel area of the overall insole.

Finally, there is provided over the base piece 10 and the heel piece 20, the top cushioning layer 30. These various components are connected together with the use of an adhesive. The adhesive is essentially applied between the base piece 10 and the heel piece 20 on the bottom side and the top cushioning layer 30 on the top side. There need not be any gluing or adhesive applied between the base piece 10 and the heel piece 20. Both of these pieces can be held in place simply by the adhesive between these pieces and the underside of the top cushioning layer 30.

Figure 5:
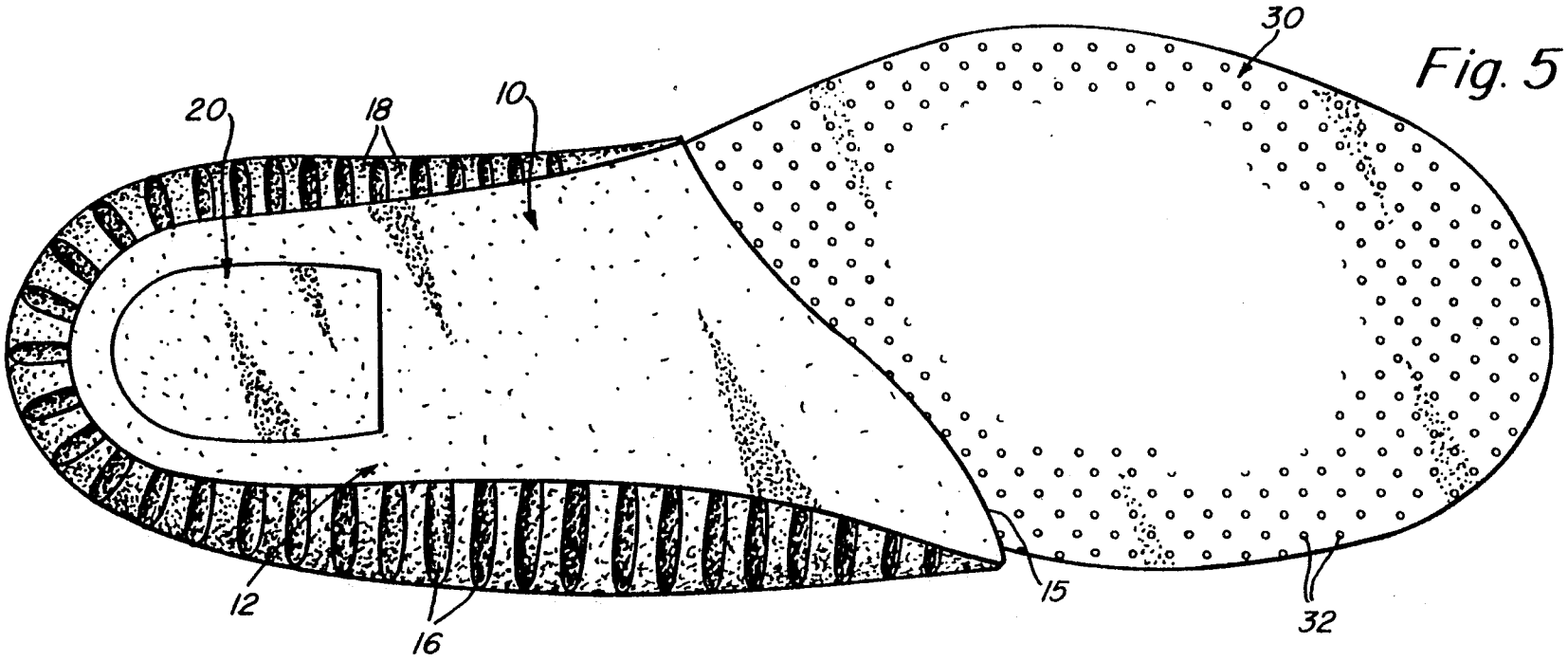
FIG. 5 is a bottom plan view of the shoe insole illustrated in FIGS. 1-4.

As illustrated, for example, in FIGS. 1, 2 and 5, the top cushioning layer extends beyond the base piece 10, and in particular beyond the front edge 15 thereof. The front portion of the layer 30 would generally underlie the ball area of the foot.

The top cushioning layer 30 is preferably provided with a series of holes 32 therethrough. These holes provide for a certain amount of air circulation to permit the foot to breathe.

The top cushioning layer 30 is preferably constructed of a foam material such as neoprene, S.B.R. or polyurethane foam. Anyone of these foam materials is preferably covered on one or both of its top and bottom surfaces with a cloth material such as brushed nylon or cambrelle.

Having now described one embodiment of the present invention, it should now become apparent to those skilled in the art that numerous other embodiments are contemplated as falling within the scope of the present invention. For example, although the embodiment described is used in a running shoe, it is understood that the principles of the invention may also be applied in the construction of other types and forms of shoes including other types of athletic shoes.

What is claimed is:

1. A shoe insole comprising:

a resilient base piece adapted to conform to the foot and having a base surface, a top surface and a cupped periphery for accommodating the heel and extending to the arch area, a heel piece disposed in a cut out opening in the base piece under the heel for absorption of shock, and a top cushioning layer having a portion thereof affixed to and overlying the resilient base piece and heel piece and having a top surface adapted to receive the foot, said portion of the top cushioning layer overlying the resilient base piece having a width that is narrower than a width of the resilient base piece;

said resilient base piece extending from the heel area forwardly to a thin front edge, said top cushioning layer extending over the base piece from the heel area thereof and forwardly beyond the thin front edge of the base piece to underlie at least the toe area, said base piece having sidewalls extending substantially normally from the top surface thereof and defining a recess within said base piece, said recess substantially conforming in shape to the portion of the top cushioning layer overlying the resilient base piece, said recess having a depth substantially equivalent to a thickness of the top cushioning layer but less than the thickness of the resilient base piece;

the top cushioning layer being positioned within said recess such that the top surface of the top cushioning layer is flush with the cupped periphery of the resilient base piece.

2. A shoe insole as set forth in claim 1 wherein the cupped periphery is comprised of a cupped wall that has ribs of the outer surface thereof and extending between a top edge of the cupped wall and the base piece base surface.

3. A shoe insole as set forth in claim 2 wherein the cupped wall is smooth on its inner surface.

4. A shoe insole as set forth in claim 1 wherein the width of the heel piece is less than the width of the heel area of the base piece.

5. A shoe insole as set forth in claim 4 wherein the thickness of the heel piece is substantially the same as the base piece thickness between top and base surfaces thereof so that the bottom of the heel piece is flush with the base piece base surface.

6. A shoe insole as set forth in claim 5 wherein the heel piece is constructed of a visco-elastic material.

7. A shoe insole as set forth in claim 5 wherein the heel piece is constructed of a soft spongy material for shock absorption with fast recovery.

8. A shoe insole as set forth in claim 1 wherein the resilient base piece is constructed of a material having memory.

9. A shoe insole as set forth in claim 1 wherein the resilient base piece is of a polyvinylchloride material.

10. A shoe insole as set forth in claim 1 wherein the top cushioning layer has holes therethrough between top and bottom surfaces.

11. A shoe insole as set forth in claim 1 wherein the top layer is of a foam material.

12. A shoe insole as set forth in claim 11 wherein the foam material is polyurethane with a cloth cover.

13. A shoe insole as set forth in claim 1 wherein the base piece tapers from the heel area to the front edge.

14. A shoe insole comprising:

a resilient base piece adapted to conform to the foot and having a base surface, a top surface and a cupped periphery for accommodating the heel and extending to the arch area, a heel piece disposed in a cut out opening in the base piece under the heel for absorption of shock, and a top cushioning layer having a portion thereof affixed to and overlying the resilient base piece and heel piece and having a top surface adapted to receive the foot, said portion of the top cushioning layer overlying the resilient base piece having a width that is narrower than a width of the resilient base piece;

said resilient base piece extending from the heel area forwardly to a thin front edge, said top cushioning layer extending over the base piece from the heel area thereof and forwardly beyond the thin front edge of the base piece to underlie at least the toe area, said base piece having sidewalls extending substantially normally from the top surface thereof and defining a recess within said base piece, said recess substantially conforming in shape to the portion of the top cushioning layer overlying the resilient base piece, said recess having a depth substantially equivalent to a thickness of the top cushioning layer but less than the thickness of the resilient base piece;

the top cushioning layer being positioned within said recess such that the top surface of the top cushioning layer is flush with the cupped periphery of the resilient base piece, wherein the cupped periphery is comprised of a cupped wall that has ribs of the outer surface thereof and extending between a top edge of the cupped wall and the base piece base surface, wherein the cupped wall is smooth on its inner surface wherein the width of the heel piece is less than the width of the heel area of the base piece, wherein the thickness of the heel piece is substantially the same as the base piece thickness between top and base surfaces thereof so that the bottom of the heel piece is flush with the base piece base surface, and wherein the heel piece is constructed of a visco-elastic material.

15. A shoe insole comprising:

a resilient base piece adapted to conform to the foot and having a base surface, a top surface and a cupped periphery for accommodating the heel and extending to the arch area, a heel piece disposed in a cut out opening in the base piece under the heel for absorption of shock, and a top cushioning layer having a portion thereof affixed to and overlying the resilient base piece and heel piece and having a top surface adapted to receive the foot, said resilient base piece extending from the heel area forwardly to a thin front edge that terminates short of a front edge of the top cushioning layer, said top cushioning layer extending over the base piece from the heel area thereof and forwardly beyond the thin front edge of the base piece to underlie at least the toe area, said resilient base piece having a base wall and a substantially cupped peripheral wall, said top cushioning layer having a contour substantially matching that of the resilient base piece base wall, the interface between said base piece base wall and said cupped peripheral wall being defined by a recess shoulder that receives said top cushioning layer therein and that is dimensioned so that the top surface of the top cushioning layer is substantially flush with the top surface of the cupped peripheral wall.

16. A shoe insole comprising:

a resilient base piece adapted to conform to the foot and having a base surface, a top surface and a cupped periphery for accommodating the heel and extending to the arch area, a heel piece disposed in a cut out opening in the base piece under the heel for absorption of shock, and a top cushioning layer having a portion thereof affixed to and overlying the resilient base piece and heel piece and having a top surface adapted to receive the foot, said resilient base piece extending from the heel area forwardly to a thin front edge that terminates short of a front edge of the top cushioning layer, said top cushioning layer extending over the base piece from the heel area thereof and forwardly beyond the thin front edge of the base piece to underlie at least the toe area, said resilient base piece having a base wall and a substantially cupped peripheral wall, said top cushioning layer having a width in the heel portion thereof that is narrower than a width of the base piece in the heel portion thereof so that the base piece cupped peripheral wall extends beyond the width of the top cushioning layer, the interface between said base piece base wall and said cupped peripheral wall being defined by a recess shoulder that receives said top cushioning layer therein and that is dimensioned so that the top surface of the top cushioning layer is substantially flush with the top surface of the cupped peripheral wall.

* * * * *